United States Patent [19]

Tomita

[11] Patent Number: 4,538,662

[45] Date of Patent: Sep. 3, 1985

[54] WINDOW HAVING DOUBLE-GLAZED SLIDING DOORS AND BLINDS

[75] Inventor: Katsuaki Tomita, Matsudo, Japan

[73] Assignee: Tachikawa Corporation, Tokyo, Japan

[21] Appl. No.: 531,050

[22] Filed: Sep. 12, 1983

[51] Int. Cl.[3] ..... E05C 7/02; E06B 3/46

[52] U.S. Cl. ..... 160/107; 160/90; 49/62

[58] Field of Search ..... 160/91, 90, 89, 107; 49/62

[56] References Cited

U.S. PATENT DOCUMENTS

| | | | |
|---|---|---|---|
| 1,278,394 | 9/1918 | Sindoni | 49/62 |
| 2,170,877 | 8/1939 | Simon | 160/91 |
| 3,057,023 | 10/1962 | Hewit | 160/91 |
| 3,318,360 | 5/1967 | Persson | 160/107 |
| 3,372,727 | 3/1968 | Lorentzen | 160/91 |
| 4,114,331 | 9/1978 | Yamamoto | 160/90 |

FOREIGN PATENT DOCUMENTS

| | | |
|---|---|---|
| 49-41844 | 4/1974 | Japan . |
| 53-43269 | 11/1978 | Japan . |
| 58-94580 | 6/1983 | Japan . |

*Primary Examiner*—Peter M. Caun
*Assistant Examiner*—Cherney S. Lieberman
*Attorney, Agent, or Firm*—Leydig, Voit & Mayer, Ltd.

[57] ABSTRACT

A window having a blind disposed between interior and exterior panes of glass. A glazed interior door is movably disposed on the lower frame of a glazed exterior door, and the blind is disposed between these doors to form a double-glazed door. A plurality of sash rollers are movably mounted to the lower frame of the interior door and capable of moving along the rails mounted to the lower frame of the exterior door. Screws are detachably screwed into the interior and exterior doors to prevent these doors from moving relative to each other. The double-glazed door is arranged on the rails in the sash via a plurality of sash rollers which are rotatably mounted to the lower frame of the exterior door.

5 Claims, 4 Drawing Figures

WINDOW HAVING DOUBLE-GLAZED SLIDING DOORS AND BLINDS

FIELD OF THE INVENTION

The present invention relates to a window having double-glazed glass doors and blinds therein.

BACKGROUND OF THE INVENTION

Windows having double-glazed sliding glass doors have heretofore been proposed to provide good sound and heat insulating properties. However, in a window of this structure, two glazed sliding glass doors are mounted in a parallel arrangement, and therefore the width of the sash is enlarged. Further, to open a window having glazed sliding doors, each door must be separately operated beginning with the operation of the interior door.

In an attempt to overcome these difficulties, a window having sliding doors as disclosed in Japanese Patent Publication No. 43269/1978 has been proposed. Specifically, the window has an interior, double-glazed sliding door and an exterior, double-glazed door, the frames of these doors being secured with metal fixtures. Thus, this double window structure can be operated in the same way as a window having single-glazed sliding doors. Further, the doors can be supported by a single sash. In addition, since horizontal blinds are mounted within the double-glazed doors, it acts as an excellent heat, sound, and sunlight insulator.

However, in order to install the sliding doors in the sash, the four glazed glass panel assemblies are required to be mounted on their respective rails one by one and thus a cumbersome operation is necessary. Further, when the glazed interior glass panel assemblies are carried and installed in the sash after the two pairs of the glazed doors are separately fixed with metal fixtures, the total load of the glazed exterior doors is imposed only on the fixtures. Hence, the fixtures are required to be strong enough to firmly fix the two doors. Additionally, the four rails juxtaposed in the sash are inconvenient to clean.

OBJECTS OF THE INVENTION

It is an object of the present invention to provide a window which includes a double-glazed sliding doors and blinds, and which is excellent in heat and sound insulating properties and capable of shielding direct rays of the sun.

It is another object of the invention to provide a window which includes double-glazed sliding doors and blinds, and which can be readily mounted on two rails on the lower end of the sash in the same way as conventional windows having sliding doors.

It is a further object of the invention to provide a window including double-glazed sliding doors and blinds, in which the load of the interior or exterior glazed glass panel assemblies is not imposed on the screws that fix the interior and exterior assemblies to each other when the doors are mounted in the sash.

It is still another object of the invention to provide a window including double-glazed sliding doors and blinds which require only a simple structure to mount the control section of an angle adjusting mechanism for adjusting the inclination of the slats in the blinds.

Other objects of the invention will become obvious upon an understanding of the illustrative embodiments about to be described and will be indicated in the appended claims, and various advantages not referred to herein will occur to one skilled in the art upon employment of the invention in practice.

DETAILED DESCRIPTION OF THE PREFERRED EMBODIMENTS

Figure 1:
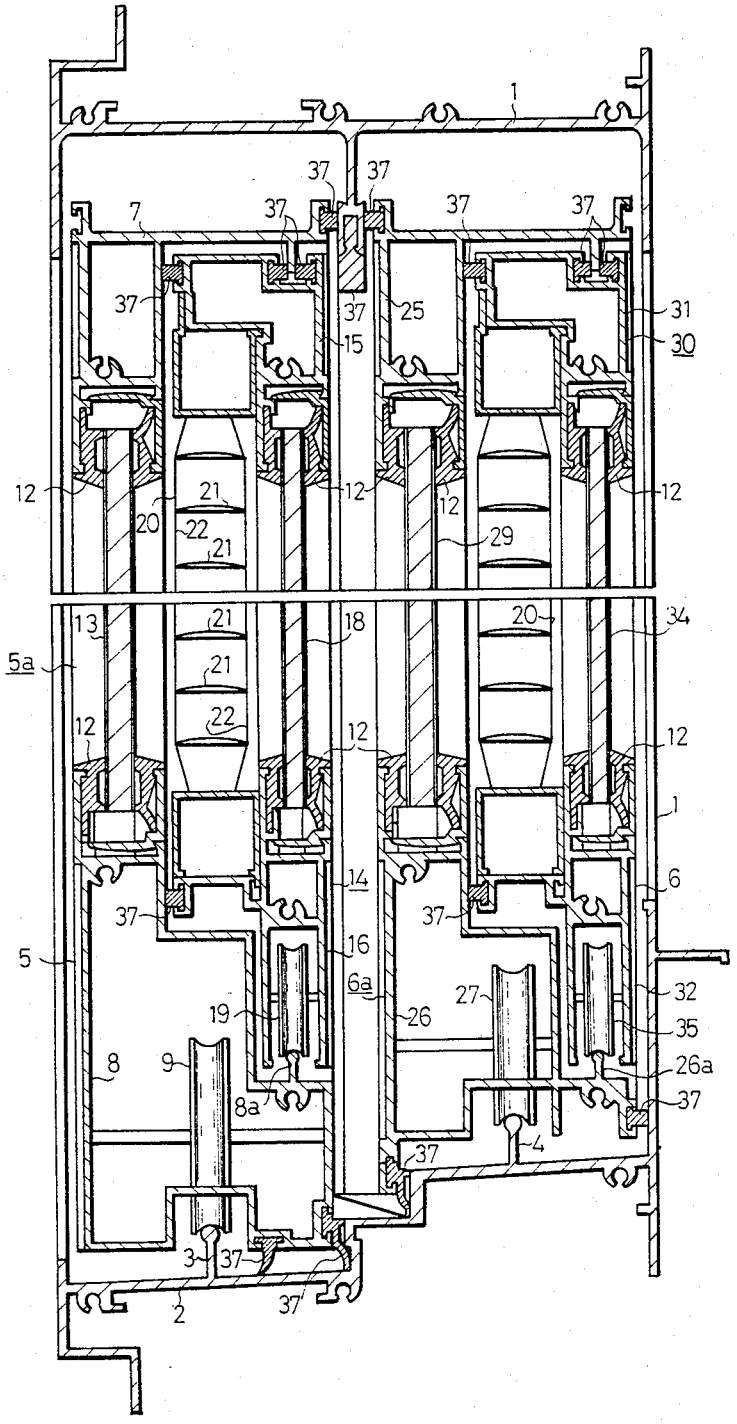
FIG. 1 is a longitudinal sectional view of a window having double-glazed sliding doors according to the present invention.

One embodiment of the present invention is now described with reference to the drawings. A sash 1 has a lower frame 2 which has multiple levels cascaded from right to left in FIG. 1. Protruding upwardly from the lower frame 2 are rails 3 and 4, each upper portion of which is shaped into a substantially circular cross section. A double-glazed sliding door 5 consists of an exterior assembly 5*a* and an interior assembly 14. Similarly, a double-glazed sliding door 6 is made up of an exterior assembly 6*a* and an interior assembly 30, as described later. A portion of the door 5 is constituted by the upper frame 7 of the exterior door 5*a*. In the lower frame 8 of the exterior door 5, a plurality of sash rollers 9 are rotatably supported and extend outwardly and downwardly from the lower frame 8. The exterior door 5*a* is movable along the rail 3. The upper surface of the lower frame 8 is shaped similar to a staircase as shown in FIG. 1, and its inner and lowermost stair is provided with a rail 8*a*. A pane of glass 13 is fitted in the space surrounded by the outer, uppermost stair of the lower frame eight, the upper frame 7, and vertical frames 10*a* and 10*b* (FIG. 2) using gaskets 12.

The double-glazed door 5 has an interior assembly 14, in which a pane of glass 18 is fitted with gaskets 12 in the space defined by the upper frame 15, the lower frame 16, and the vertical frames 17*a* and 17*b* (FIG. 2) of the interior assembly. A plurality of sash rollers 19 are rotatably supported in the lower frame 16 whose lower end is open. The rollers 19 permit the interior assembly 14 to move along the rail 8*a*.

A blind 20 is so supported by the upper frame 15 of the interior assembly 14 as to depend therefrom between the panes 13 and 18 of the exterior assembly 5*a* and the interior assembly 14, respectively. In the blind 20, a number of slats 21 are held by ladder cords 22. An angle adjusting mechanism (not shown) is mounted in the upper frame 15 of the interior door 14 to control the inclination of the slats 21 in the blind 20, and the mechanism has a control section (not shown) disposed in the vertical frame 17*b* of the interior assembly 14.

Figure 2:
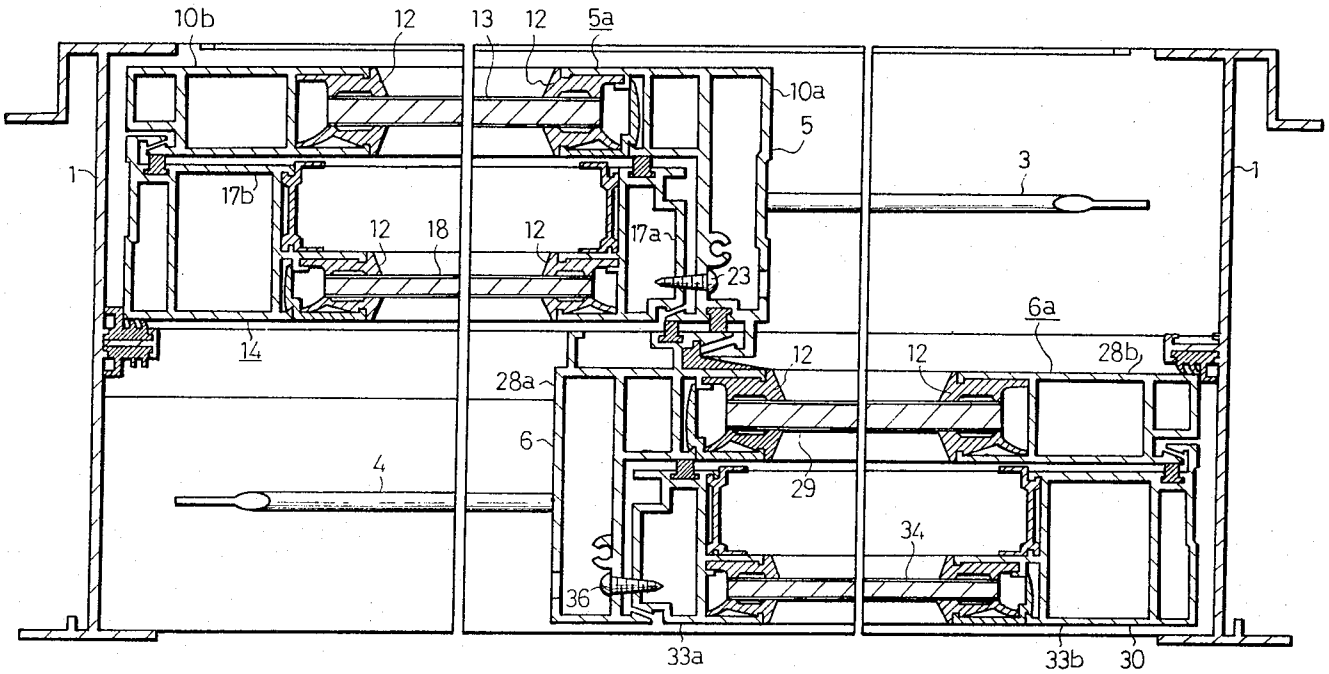
FIG. 2 is a transverse sectional view of the window of FIG. 1.
Figure 4:
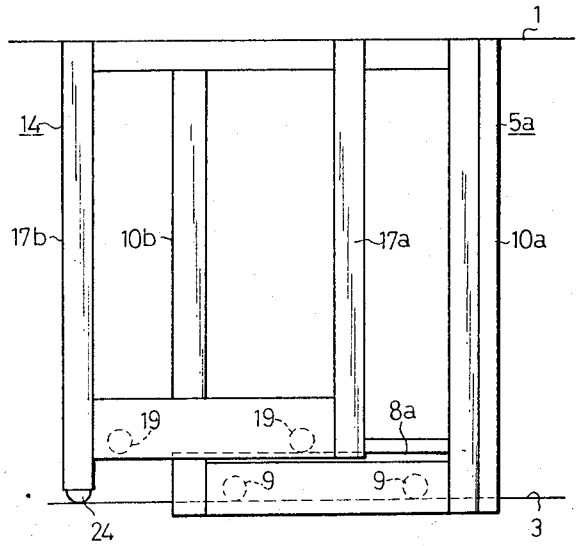
FIG. 4 is a schematic front elevation of the window of FIG. 1, for showing the manner in which the exterior and interior doors are moved relative to each other.

As shown in FIG. 2, at least one screw 23 is provided to prevent the right vertical frame 10*a* of the exterior assembly 5*a* and the right vertical frame 17*a* of the interior assembly 14 from moving relative to each other. The screw ordinarily fixes the interior assembly 14 to the exterior assembly 5*a* to form the double-glazed door 5 of a double window structure.

Figure 3:
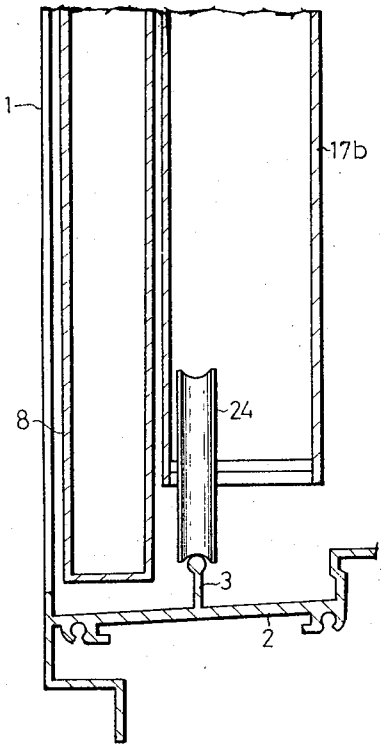
FIG. 3 is a longitudinal sectional view of one vertical frame of the window shown in FIG. 1.

As shown in FIG. 3, the left end portion of the lower frame 8 of the exterior assembly 5*a* is not provided with the aforementioned staircase-like portion, but the left vertical frame 17*b* of the interior assembly 14 extends to that position instead. A sash roller 24 is rotatably secured to the open lower end portion of the vertical frame 17*b* and movable along the aforementioned rail 3. Therefore, when the screw 23 is removed and the interior assembly 14 is moved relative to the exterior assembly 5*a*, the interior assembly 14 is supported by the sash rollers 24 and 19 moving along the rails 3 and 8*a*, respectively.

The upper frame 25 of the exterior assembly 6*a* forms a portion of the double-glazed door 6 of the double window structure. Similarly, the lower frame 26 of the exterior assembly 6*a* forms a portion of the double-glazed door 6, and a sash roller 27 is rotatably supported in the frame 26, so that the exterior assembly 6*a* is movable along the rail 4. The upper surface of the lower frame 26 is formed like a staircase as shown in FIG. 1. The inner and lowermost stair of the staircase-like structure is provided with a rail 26*a*. A pane of glass 29 is supported with gaskets 12 in the space surrounded by the outer uppermost stair, the upper frame 25, and the vertical frames 28*a* and 28*b*.

The interior assembly of the double-glazed door 6 of the double window structure is indicated by reference numeral 30. A pane of glass 34 is fixed with gaskets 12 in the space surrounded by the upper frame 31, the lower frame 32, and the vertical frames 33*a* and 33*b* of the interior assembly 30. In the lower frame 32 whose lower end is open, a sash roller 35 is rotatably supported such that the interior door 30 is movable along the rail 26*a*. A blind 20 is disposed between pane 29 of the exterior assembly 6*a* and the pane 34 of the interior assembly 30 similarly to the case of the above-described double-glazed exterior door 5.

As shown in FIG. 2, the left vertical frame 28*a* of the exterior assembly 6*a* and the left vertical frame 33*a* of the interior assembly 30 are made immovable relative to each other by at least one screw 36, which ordinarily fixes the interior assembly 30 to the exterior assembly 6*a*, thus constituting the double-glazed door 6 of the double window structure. The right vertical frame 33*b* of the interior assembly 30 extends downwardly in the same way as the aforementioned left vertical frame 17*b* of the interior assembly 14, and a sash roller which is movable along the rail 4 is rotatably secured to the lower end of the right vertical frame 33*b*.

As shown in FIG. 1, heat-insulating material 37 is stuffed between the opposing portions, namely, between the sash 1 and the lower frames 8, 26, between the sash 1 and the upper frames 7, 25, and between the upper frames 7, 25 of the exterior assemblies 5*a*, 6*a* and the upper frames 15, 31 of the interior doors 14, 30. Thus, these opposing portions are isolated from each other, and the inside of the double-glazed doors 5 and 6 is thermally insulated from the outside, whereby the warmth inside of the double window structure is preserved well.

The operation of the window having the double-glazed sliding doors as described above is now described. To mount the double-glazed doors 5 and 6 in the sash 1, the interior assemblies 14 and 30 are first mounted on the rails 8*a* and 26*a* installed on the lower frames 8 and 26, respectively, of the exterior assemblies 5*a* and 6*a*. Then, the interior assemblies 14 and 30 are fixed to the exterior assemblies 5*a* and 6*a*, respectively, with the screws 23 and 36, thus forming the double-glazed doors 5 and 6. These doors 5 and 6 are then mounted on the rails 3 and 4, respectively, of the sash 1 with the result that the double-glazed sliding doors are movably mounted in the sash 1.

Consequently, since the double-glazed doors 5 and 6 can be mounted in the sash 1 under such a condition that the interior assemblies 14 and 30 are installed to the exterior assemblies 5*a* and 6*a*, the mounting operation is quite easy to perform. Further, as the interior assemblies 14 and 30 are mounted to the exterior assemblies 5*a* and 6*a*, the load of the interior assemblies 14 and 30 will not imposed on the screws 23 and 36 when they are mounted in the sash 1. Hence, the screws 23 and 36 are not required to have a sufficient strength to withstand the load of the interior assemblies 14 and 30. In addition, even in case where the screws 23 and 36 are omitted, the interior assembly 14 and the exterior assembly 5*a* can be moved in unison in the form of the double-glazed door 5 by manually operating the vertical frames 10*a* and 28*a* of the exterior assemblies 5*a* and 6*a*. Likewise, the interior assembly 30 and the exterior assembly 6*a* can be moved simultaneously in the form of the double-glazed door 6 by manually operating the vertical frames 17*b* and 33*b* of the interior doors 14 and 30.

In the prior art construction described above, the incorporated blinds are mounted to the glazed exterior doors, and the angle adjusting mechanism for controlling the inclination of the slats is required to have its control section mounted in the vertical frames of the interior assemblies, thus making the structure complicated and tending to cause malfunction. In constrast with this, the blinds 20 depend from the upper frames 15 and 31 of the interior assemblies 14 and 30 in this embodiment and so the control section of the angle adjusting mechanism can be readily mounted in the vertical frames of the interior assemblies 14 and 30.

In this way, in the double-glazed doors 5 and 6, the interior assemblies 14 and 30 are mounted on the lower frames 8 and 26 of the exterior doors 5*a* and 6*a* which can move along the rails 3 and 4 of the sash 1, and the blinds 20 are mounted between the interior assemblies 14, 30 and the exterior assemblies 5*a*, 6*a*, respectively. Therefore, the double glazing structure exhibits excellent heat and sound insulating properties. Also, it is possible to shield the direct rays of the sun by controlling the inclination of the slats 21 of the blinds 20. Further, this structure can be readily mounted in the sash 1 and is convenient to clean, because the sash 1 is provided with only two rails 3 and 4.

In the above embodiment, the sash rollers 19 and 35 permit the interior assemblies 14 and 30 to move along the rails 8*a* and 26*a* mounted on the lower frames 8 and 26 of the exterior assemblies 5*a* and 6*a*, respectively. Alternatively, the rails 8*a* and 26*a* may be omitted from the lower frames 8 and 26 such that they may be moved on the upper surfaces of these lower frames by means of the sash rollers 19 and 35, respectively. It is also possible to move the sash roller 24 on the upper frame 2. Furthermore, the panes 13 and 18 in the above embodiment may be replaced with transparent plates of plastic.

As hereinbefore described in detail, according to the present invention, double-glazed sliding doors incorporating the blinds can be easily constructed, can be supported by the two rails 3 and 4 of the sash 1, and can readily be installed.

As many apparently widely different embodiments of this invention may be made without departing from the spirit and scope thereof, it is to be understood that the invention is not limited to the specific embodiments thereof except as defined in the appended claims.

What is claimed is:

1. A double-glazed sliding door and blind, the door comprising:

a sash having a lower frame, an exterior assembly including glazed glass and having a lower frame for longitudinal movement along said lower frame of said sash, interior assembly including glazed glass and disposed on the lower frame of the exterior assembly so as to be movable longitudinally, blinds mounted between the exterior assembly and the interior assembly, and rails for supporting the exterior assembly on said lower frame of said sash.

2. A double-glazed sliding door and blind as set forth in claim 1, wherein the blinds are mounted to the respective interior assemblies and movable together with same.

3. A double-glazed sliding door and blind as set forth in claim 2, wherein the glazed interior assembly consists of an upper frame, a lower frame, a left side frame, a right side frame, and a pane of glass fitted in the space formed by these frames, and wherein the blinds are so supported as to depend from the respective upper frames of the interior assembly.

4. A double-glazed sliding door and blind as set forth in claim 3, wherein the glazed interior assembly has a plurality of sash rollers rotatably mounted to the lower frame of the interior assembly, the sash rollers being movable along a rail installed on the lower frame of the exterior assembly.

5. A window having double-glazed sliding doors and blinds, the window comprising:

glazed exterior assemblies and interior assemblies supported on the lower frame of the sash of said window;

lower frames installed in said exterior and interior assemblies so as to permit said assemblies to move longitudinally;

blinds mounted between one of said exterior assemblies and an associated one of said interior assemblies; and supporting means disposed in the open lower end portion of the one vertical frame of the interior assemblies mounted on said lower frames, the supporting means being mounted on the lower frame of said sash.

* * * * *